US009917354B2

(12) United States Patent
Feng et al.

(10) Patent No.: US 9,917,354 B2
(45) Date of Patent: Mar. 13, 2018

(54) MULTIBAND VEHICULAR ANTENNA ASSEMBLY

(71) Applicant: Laird Technologies Shanghai CO., LTD., Shanghai (CN)

(72) Inventors: Zusheng Feng, Shanghai (CN); Gary Yang, Shanghai (MO); Samuel Sun, Shanghai (CN); Jinfeng Sun, Shanghai (CN)

(73) Assignee: Laird Technologies (Shanghai) Co., Ltd., Shanghai (CN)

( * ) Notice: Subject to any disclaimer, the term of this patent is extended or adjusted under 35 U.S.C. 154(b) by 71 days.

(21) Appl. No.: 15/220,544

(22) Filed: Jul. 27, 2016

(65) Prior Publication Data

US 2017/0033450 A1 Feb. 2, 2017

(30) Foreign Application Priority Data

Jul. 27, 2015 (CN) ..... 2015 1 0447640
Jul. 27, 2015 (CN) ..... 2015 2 0550356 U

(51) Int. Cl.

| | |
|---|---|
| ***H01Q 1/32*** | (2006.01) |
| ***H01Q 9/04*** | (2006.01) |
| ***H01Q 21/28*** | (2006.01) |
| *H01Q 1/42* | (2006.01) |

(52) U.S. Cl.

CPC ..... *H01Q 1/3275* (2013.01); *H01Q 9/0407* (2013.01); *H01Q 21/28* (2013.01); *H01Q 1/42* (2013.01)

(58) Field of Classification Search

CPC ..... H01Q 1/3275; H01Q 1/42; H01Q 1/32; H01Q 21/28; H01Q 9/0407

See application file for complete search history.

(56) References Cited

U.S. PATENT DOCUMENTS

| | | | | |
|---|---|---|---|---|
| 5,706,015 | A * | 1/1998 | Chen | H01Q 1/3275 343/700 MS |
| 9,653,808 | B2 * | 5/2017 | Hwang | H01Q 9/0414 |
| 2007/0146206 | A1 * | 6/2007 | Sun | H01Q 9/0435 343/700 MS |
| 2015/0071137 | A1 * | 3/2015 | Thiam | H01Q 9/0407 370/297 |
| 2016/0064807 | A1 * | 3/2016 | Reed | H01Q 1/3275 343/713 |

* cited by examiner

*Primary Examiner* — Tho G Phan

(74) *Attorney, Agent, or Firm* — Harness, Dickey & Pierce, P.L.C.

(57) ABSTRACT

Exemplary embodiments are disclosed of multiband vehicular antenna assemblies with Global Navigation Satellite System (GNSS) capabilities. In exemplary embodiments, a multiband antenna assembly is operable with more than two satellite navigation system frequencies (e.g., Global Positioning System (GPS), BeiDou Navigation Satellite System (BDS), the Russian Global Navigation Satellite System (GLONASS), etc.). For example, a multiband antenna assembly may include a first patch antenna operable with at least three different satellite navigation system frequencies, e.g., GPS, BeiDou, and GLONASS, etc. The first patch antenna may be stacked on a second patch antenna. The second patch antenna may be operable with other frequencies, such as Satellite Digital Audio Radio Services (SDARS) signals (e.g., Sirius XM, etc.). The antenna assembly may also include a coupler that couples the signals from the feed ports of the first patch antenna.

19 Claims, 17 Drawing Sheets

MULTIBAND VEHICULAR ANTENNA ASSEMBLY

CROSS-REFERENCE TO RELATED APPLICATIONS

This application claims the benefit of and priority to Chinese Invention Patent Application No. 201510447640.1 filed Jul. 27, 2015 and Chinese Utility Model Application 201520550356.2 filed Jul. 27, 2015, which granted Dec. 15, 2015 as Chinese Utility Model Patent No. ZL201520550356.2. The entire disclosures of the above applications are incorporated herein by reference.

FIELD

The present disclosure generally relates to multiband vehicular antenna assemblies.

BACKGROUND

This section provides background information related to the present disclosure which is not necessarily prior art.

Various different types of antennas are used in the automotive industry, including AM/FM radio antennas, Satellite Digital Audio Radio Service (SDARS) antennas, Global Navigation Satellite System (GNSS) antennas, cellular antennas, etc. Multiband antenna assemblies are also commonly used in the automotive industry. A multiband antenna assembly typically includes multiple antennas to cover and operate at multiple frequency ranges.

Automotive antennas may be installed or mounted on a vehicle surface, such as the roof, trunk, or hood of the vehicle to help ensure that the antennas have unobstructed views overhead or toward the zenith. The antenna may be connected (e.g., via a coaxial cable, etc.) to one or more electronic devices (e.g., a radio receiver, a touchscreen display, navigation device, cellular phone, etc.) inside the passenger compartment of the vehicle, such that the multiband antenna assembly is operable for transmitting and/or receiving signals to/from the electronic device(s) inside the vehicle.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
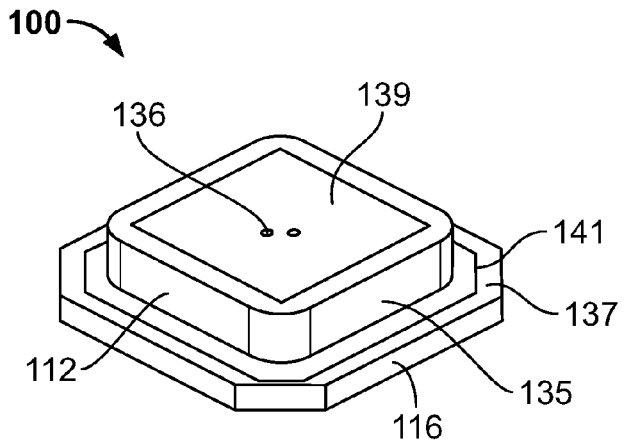
FIG. 1 is a perspective view of a multiband antenna assembly configured to be operable with GPS, BeiDou, GLONASS, and SDARS according to an exemplary embodiment.

Example embodiments will now be described more fully with reference to the accompanying drawings.

The inventors hereof recognized a need for a small multiband antenna (e.g., shark fin antenna, etc.) with Global Navigation Satellite System (GNSS) capabilities, e.g., operable with more than two satellite navigation system frequencies (e.g., Global Positioning System (GPS), BeiDou Navigation Satellite System (BDS), the Russian Global Navigation Satellite System (GLONASS), etc.). Accordingly, the inventors have disclosed herein exemplary embodiments of multiband antenna assemblies or systems operable with more than two satellite navigation system frequencies. For example, an exemplary embodiment of a multiband antenna assembly may include a first patch antenna operable with at least three different satellite navigation system frequencies, e.g., GPS, BeiDou, and GLONASS, etc. The first patch antenna may be stacked on a second patch antenna. The second patch antenna may be operable with other frequencies, such as Satellite Digital Audio Radio Services (SDARS) signals (e.g., Sirius XM, etc.). The antenna assembly may also include a coupler that couples the signals (e.g., satellite navigation system signals, etc.) from the feed ports of the first patch antenna.

In exemplary embodiments disclosed herein, an antenna assembly may include a patch antenna operable with GPS, BDS, and GLONASS and a patch antenna operable with SDARS. The GPS/BDS/GLONASS patch antenna may be stacked on another patch. In such exemplary embodiments, the antenna assembly may thus include a first or top patch antenna compatible with all three of GPS, BDS, and GLONASS. The first patch antenna may include first and second feed ports. Signals from the first and second feed ports are coupled through a coupler. The second or bottom patch antenna may be operable for receiving other satellite signals, such as Satellite Digital Audio Radio Services (SDARS) signals (e.g., Sirius XM, etc.). The stacked patch antennas may be positioned on and/or supported by a common base or chassis (e.g., base 252 shown in FIGS. 9 through 11, etc.) and housed within or disposed under a radome or cover (e.g., radome 244 shown in FIGS. 6 through 8, etc.). The radome or cover may have a shark fin shape, and the antenna assembly may be referred to as a shark fin antenna.

In some exemplary embodiments, the antenna assembly may also include one or more other antennas in addition to a satellite navigation system patch antenna and a satellite radio patch antenna. The one or more other antennas may be located rearward of the patch antennas and/or closer to a back of the antenna assembly (e.g., along the PCB 248 in FIG. 9, etc.). For example, an antenna assembly may also include one or more cellular antennas (e.g., an inverted F antenna (IFA), a monopole antenna, an inverted L antenna (ILA), a planar inverted F antenna (PIFA), a stamped mast antenna, other mast antenna, etc.).

According to various aspects, exemplary embodiments are disclosed of multiband vehicular antenna assemblies for installation to a vehicle body wall. In exemplary embodiments, a multiband vehicular antenna assembly generally includes at least one patch antenna configured to be operable with Global Navigation Satellite System (GNSS) frequencies. The patch antenna may be configured to be operable for receiving and transmitting communication signals over at least GPS, BeiDou, and GLONASS (e.g., 1561 to 1605 MHz, 45 MHz, etc.) wide band and/or other GNSS frequency bands. The multiband vehicular antenna assembly may also include a second patch antenna configured to be operable for receiving and transmitting other satellite signals, such as SDARS signals. By way of example, a patch antenna disclosed herein may have a length of 25 millimeters (mm), a width of 25 mm, and height or thickness of 6 mm. But these dimensions are examples only as larger or smaller patch antennas may be used in other exemplary embodiments.

The inventors hereof have found that their patch antenna operable with GPS, BDS, and GLONASS signals are suitable to be stacked with a patch antenna operable with SDARS signals, which stacked patch antennas may be used with automotive antenna systems. In some exemplary embodiments, the multiple antennas are configured (e.g., sized, shaped, closely spaced, isolated, etc.) such that the antenna assembly may be disposed within or under some existing radomes or covers (e.g., shark-fin radomes, etc.). This, in turn, allows the inventors' antenna assemblies to be usable with some existing antenna radomes despite the satellite antenna operable with at least three GNSS frequency bands, e.g., GPS/BeiDou/GLONASS, as the overall size has not been considerably increased.

By way of example, either or both of the first and second patch antennas herein may be configured to be operable within one or more frequency bandwidths associated with satellite communications, such as one or more (or all) of 1561 to 1605 MHz and 45 MHz bandwidths. In some exemplary embodiments, the first and second patch antennas may be configured such that the antenna assembly is operable practically anywhere in the world due to the numerous and varied frequencies over which the antenna assembly is operable.

Figure 2:
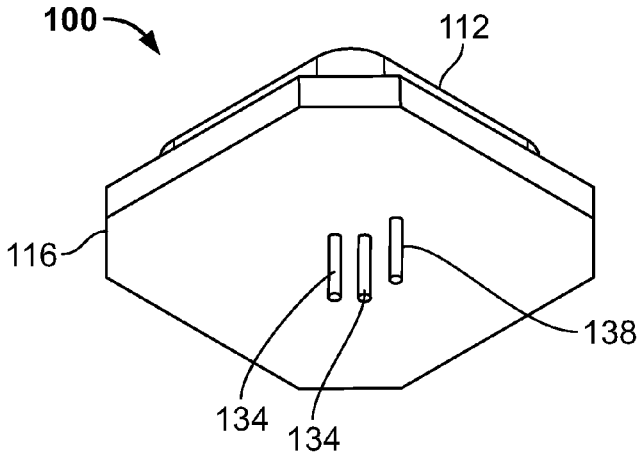
FIG. 2 is a lower perspective view of the multiband antenna assembly shown in FIG. 1, and illustrating the feeds or ports from the upper (GPS/BDS/GLONASS) patch antenna and the feed from the lower (SDARS) patch antenna.
Figure 3:
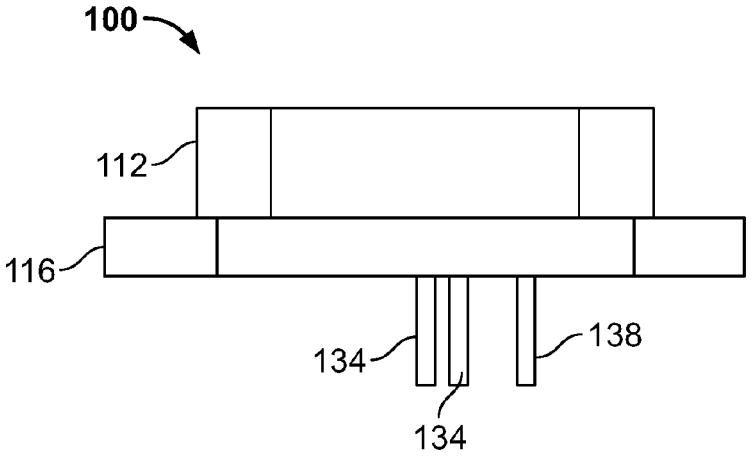
FIG. 3 is a side view of the multiband antenna assembly shown in FIGS. 1 and 2.

With reference now to the figures, FIGS. 1 through 3 illustrate an antenna assembly 100 embodying one or more aspects of the present disclosure. As shown in FIG. 1, the antenna assembly 100 includes a first or upper patch antenna 112 and a second or lower patch antenna 116.

In this example embodiment, the first patch antenna 112 is configured to be operable for receiving GNSS signals, including at least GPS, BDS, and GLONASS signals. The second patch antenna 116 is configured to be operable for receiving SDARS signals (e.g., Sirius XM, etc.). The first and second patch antennas 112, 116 are in a stacked arrangement with the first patch antenna 112 stacked on top of the second patch antenna 116. In exemplary embodiments, the SDARS signals may be fed via a coaxial cable to a SDARS radio, which, in turn, may be located in an Instrument Panel (IP) that is independent from a Telematics Control Unit (TCU) box. By way of background, the frequency range or bandwidth of GPS(L1) is 1575.42 MHz±1.023 MHz, the frequency range or bandwidth of BDS(B1) is 1561.098 MHz±2.046 MHz, the frequency range or bandwidth of GLONASS(L1) is 1602.5625 MHz±4 MHz, and the frequency range or bandwidth of SDARS is 2320 MHz to 2345 MHz. Also, for example, the first patch antenna 112 may be operable from about 1558 MHz to about 1608 MHz.

Figure 4:
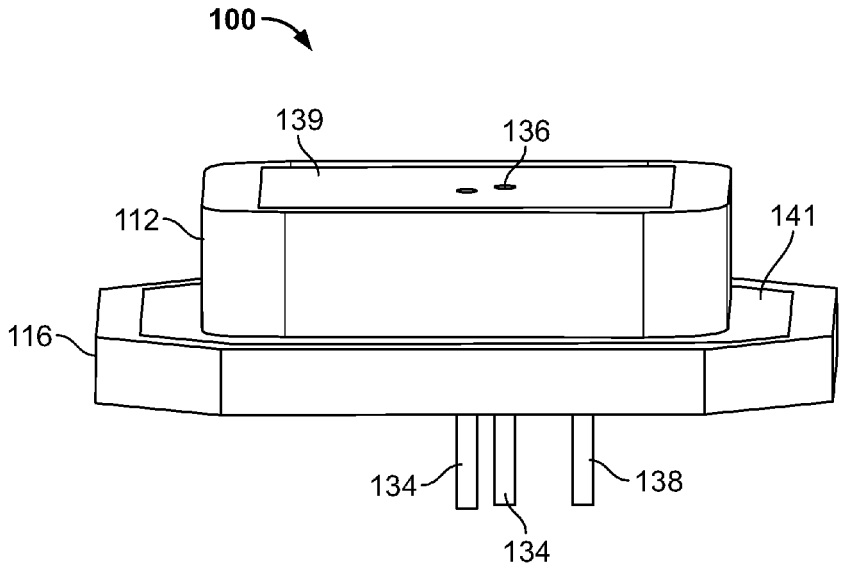
FIG. 4 is a perspective view of the multiband antenna assembly shown in FIGS. 1 through 3.

As shown in FIGS. 2 through 4, the first patch antenna 112 includes two connectors or feed ports 134 (e.g., feed pins, interlayer connectors, other feeds, etc.) respectively extending from two feed points 136 (FIGS. 1 and 4) through the first patch antenna 112. The first and second patch antennas 112, 116 may include through holes corresponding to the number of connectors 134 to allow the connectors 134 to pass through the first and second patch antennas 112, 116 for connection to a printed circuit board underneath the second patch antenna 116. Alternatively, the connectors 134 may extend around either or both the first and/or second patch antenna 112, 116 in other embodiments.

Also shown in FIGS. 2 through 4, the second patch antenna 116 includes a connector or feed port 138 (e.g., feed pin, interlayer connector, other feeds, etc.) extending from a feed point through the second patch antenna 116. The second patch antenna 116 may include a through hole to allow the connector 138 to pass through the second patch antenna 116 for connection to a printed circuit board underneath the second patch antenna 116. Alternatively, the connector 138 may extend around the second patch antenna 116 in other embodiments.

With continued reference to FIG. 1, each patch antenna 112, 116 may include a substrate 135, 137, respectively, made of dielectric material (e.g., ceramic, etc.). An electrically conductive material may be disposed on the upper surface of the substrates 135, 137 to form the antenna structure 139, 141 (e.g., $\lambda/2$-antenna structure, etc.) of the respective patch antennas 112, 116. The connectors 134 may be electrically connected to the antenna structure 139 of the first patch antenna 112. The connector 138 may be electrically connected to the antenna structure 141 of the second patch antenna 116.

Figure 5:
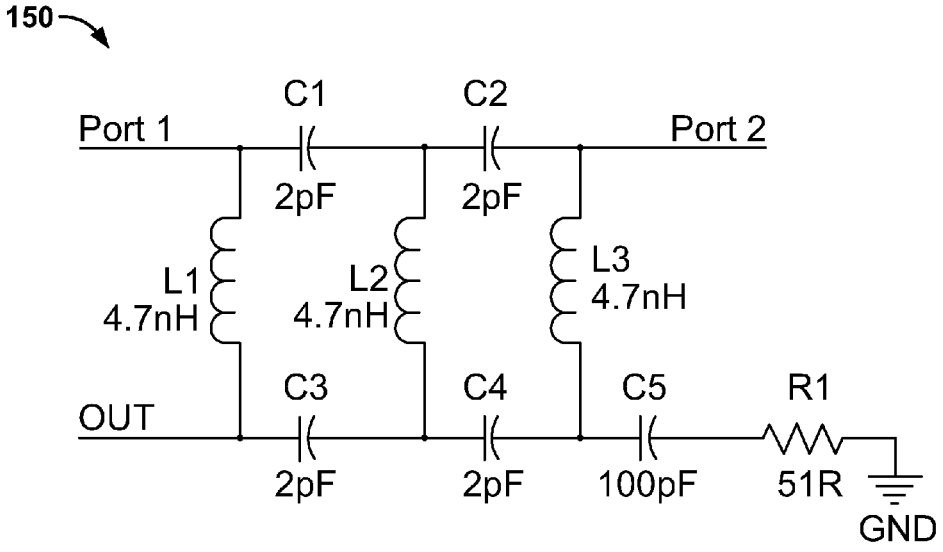
FIG. 5 is a diagram of a coupler circuit that may be used for coupling signals from the feed ports of the upper (GPS/BDS/GLONASS) patch antenna of the multiband antenna assembly shown in FIGS. 1 through 4 according to an exemplary embodiment.

FIG. 5 illustrates an exemplary embodiment of a coupler circuit 150 that may be used for coupling signals from the feed ports 134 of the GPS/BDS/GLONASS patch antenna 112. In operation, the connectors or ports 134 may receive satellite signals (e.g., GPS, BDS, GLONASS, etc.) from the patch antenna 112. The signals from the two ports 134 may then be coupled through the coupler 150. Although the coupler 150 is being used with patch antennas 112, 116 in this example, the coupler 150 may be used with other patch antennas and other antennas besides patch antennas.

A shown in FIG. 5, the coupler circuit 150 is electrically connected between or to Port 1 and Port 2 (which are input ports), to an output port (OUT), and to ground (GND). The coupler circuit 150 includes three inductors L1, L2, and L3 in parallel with each other. The coupler circuit 150 also includes first and second capacitors C1 and C2 in series between Port 1 and Port 2. The coupler circuit 150 further includes third, fourth, and fifth capacitors C3, C4, and C5 and a resistor R1 in series between the output (OUT) and the ground (GND). The first and third capacitors C1 and C3 are electrically connected generally between the first and second inductors L1 and L2. The second and fourth capacitors C2 and C4 are electrically connected generally between the second and third inductors L2 and L3.

In this example, the capacitors C1, C2, C3, C4, C5, the inductors L1, L2, L3, and L4, and the resistor R1 constitute or define a 3 decibel (dB) coupler working at 1.5 GHz to 1.8 GHz. Port 1 and Port 2 are input ports, and the OUT port is an output port. The fifth capacitor C5 and the resistor R1 isolate and absorb the unbalanced signal. The signal input from Port 1 has a 90 degree phase ahead of Port 2. Therefore, there is a 90 degree phase difference at the patch antenna feed point. The 2 signals are combined at the 3 dB coupler such that the OUT output port phase is the same. The coupler may also be referred to as a hybrid coupler. Example values for the coupler circuit 150 are as follows:

First Inductor L1: 4.7 nanoHenries (nH)
Second Inductor L2: 4.7 nH
Third Inductor L3: 4.7 nH
First Capacitor C1: 2 picoFarads (pF)
Second Capacitor C2: 2 pF
Third Capacitor C3: 2 pF
Fourth Capacitor C4: 2 pF
Fifth Capacitor C5: 100 pF
Resistor R1: 51 Ohms The specific values for the inductors, capacitors, and resistor are examples in nature, as other example embodiments may be configured differently, e.g., with higher or lower capacitance, inductance, and/or resistance. For example, the capacitors C1, C2, C3, and C4 may have a capacitance within a range from about 1.8 picoFarads to about 2.2 picoFarads, while the capacitor C5 may have a capacitance within a range from about 90 picoFarads to about 110 picoFarads. Also by way of example, the inductors L1, L2, and L3 may have an inductance within a range from about 4.5 nanoHenries to about 4.9 nanoHenries, while the resistor R1 may have a resistance within a range from about 45 Ohms to about 55 Ohms.

In exemplary embodiments, the stacked patch antennas (e.g., patch antennas 112, 116, etc.) may be positioned on a printed circuit board and/or supported by a common chassis or base and housed within or disposed under a radome or cover. The radome or cover may have a shark fin shape, and the antenna assembly may be referred to as a shark fin antenna.

Figure 6:
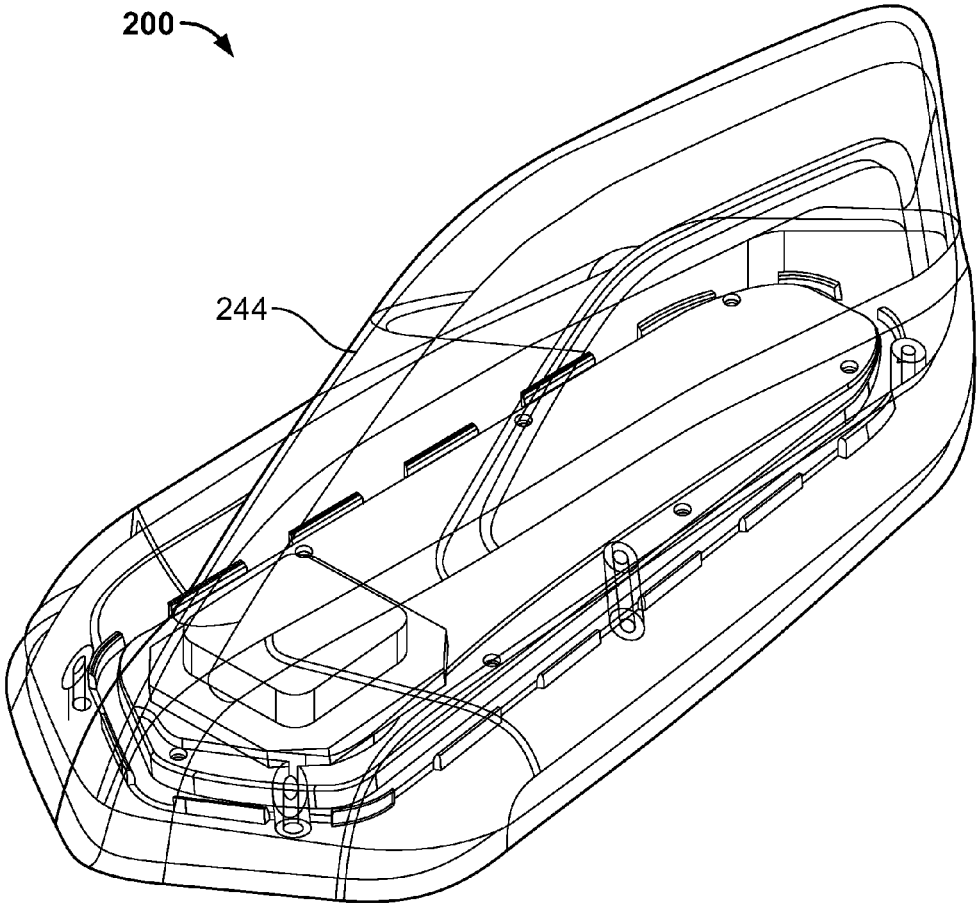
FIG. 6 is a perspective view showing a multiband antenna assembly configured to be operable with GPS, BeiDou, GLONASS, and SDARS according to an exemplary embodiment, where the example radome is shown transparent to illustrate the stacked patch antennas underneath the radome.
Figure 7:
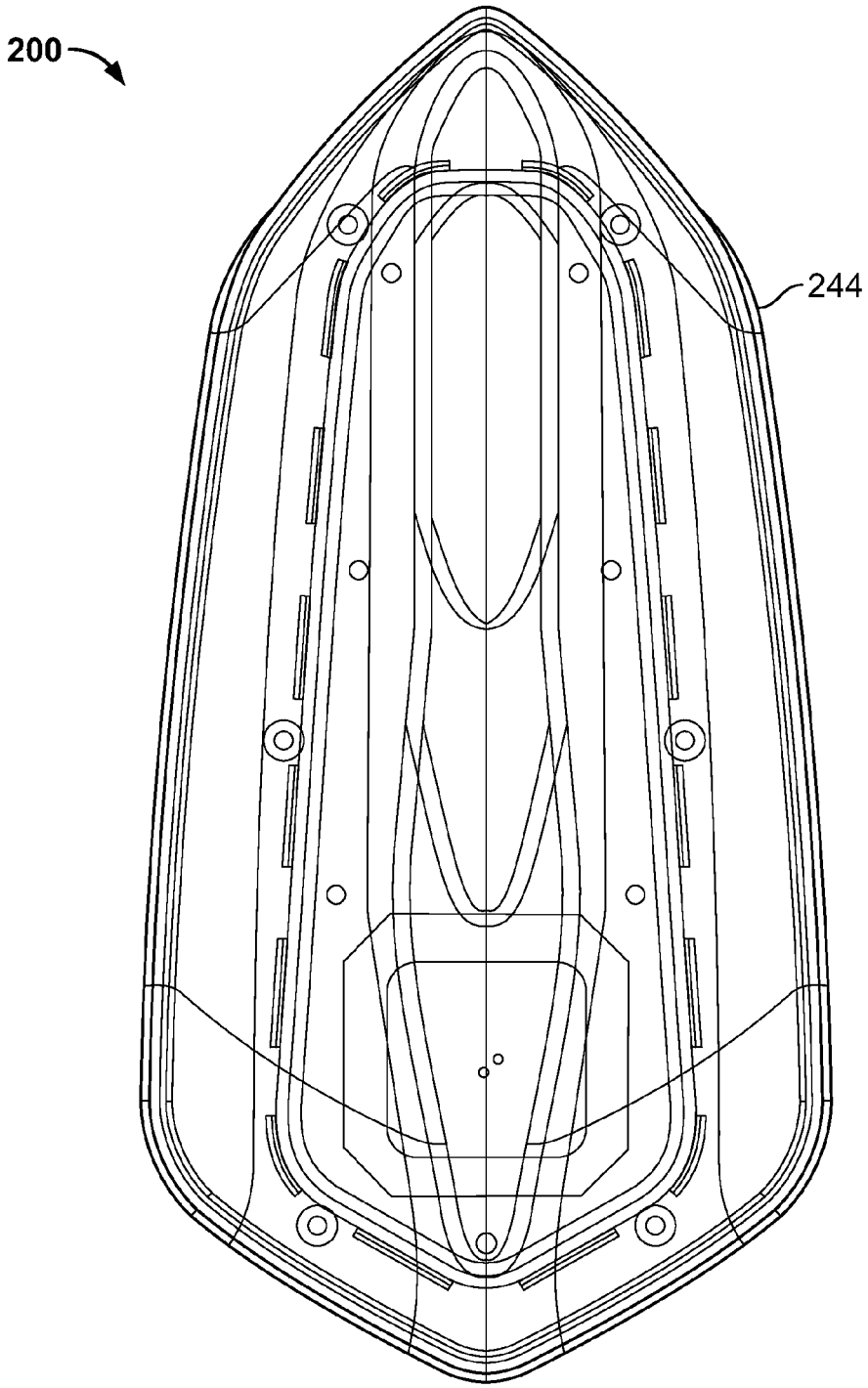
FIG. 7 is an upper view of the multiband antenna assembly and radome shown in FIG. 6.
Figure 8:
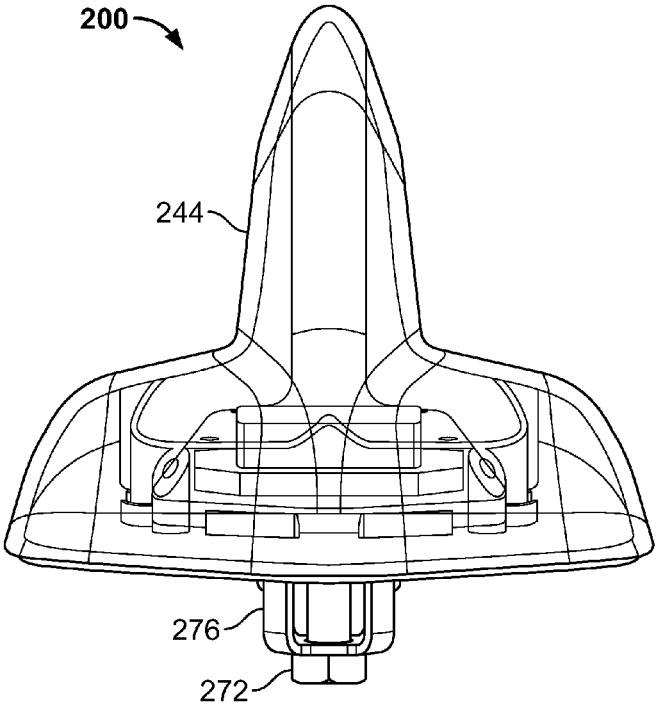
FIG. 8 is a front view of the multiband antenna assembly and radome shown in FIG. 6.

FIGS. 6 through 8 illustrate an exemplary embodiment of a multiband antenna assembly 200 that is configured to be operable with GPS, BeiDou, GLONASS, and SDARS as disclosed herein. The example radome 244 is shown transparent to illustrate the stacked patch antennas 212, 216 underneath the radome 244. The patch antenna 212 may be operable with GPS, BDS, and GLONASS. The patch antenna 216 may be operable with SDARS. The GPS/BDS/GLONASS patch antenna 212 is stacked on the SDARS patch 216.

As shown in FIG. 8, the antenna assembly 200 also includes a fastener member 272 (e.g., threaded mounting bolt having a hexagonal head, etc.) and a retention component 276 (e.g., clip, etc.). The fastener member 272 and retention component 276 may be used to mount the antenna assembly 200 to an automobile roof, hood, trunk (e.g., with an unobstructed view overhead or toward the zenith, etc.) where the mounting surface of the automobile acts as a ground plane for the antenna assembly 200 and improves reception of signals.

Figure 9:
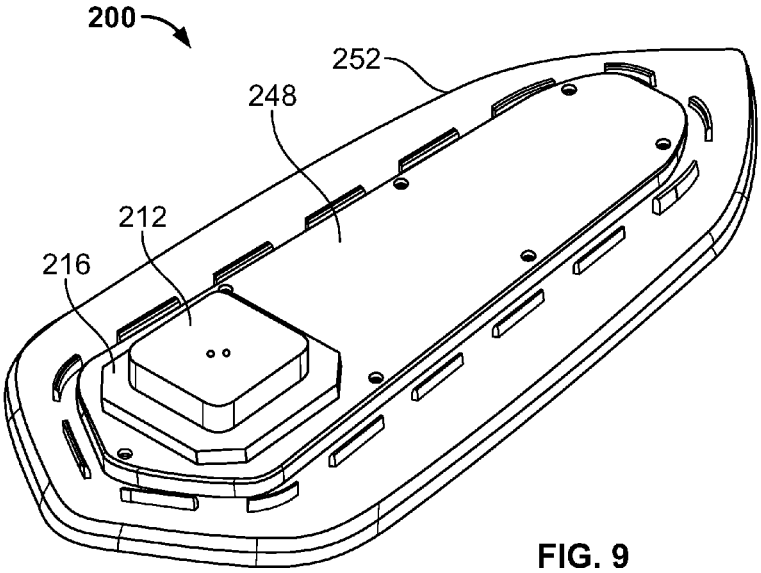
FIG. 9 is a perspective view of the multiband antenna assembly shown in FIG. 6 without the radome, and illustrating the stacked patch antennas positioned on a printed circuit board and/or supported by a common chassis or base.
Figure 10:
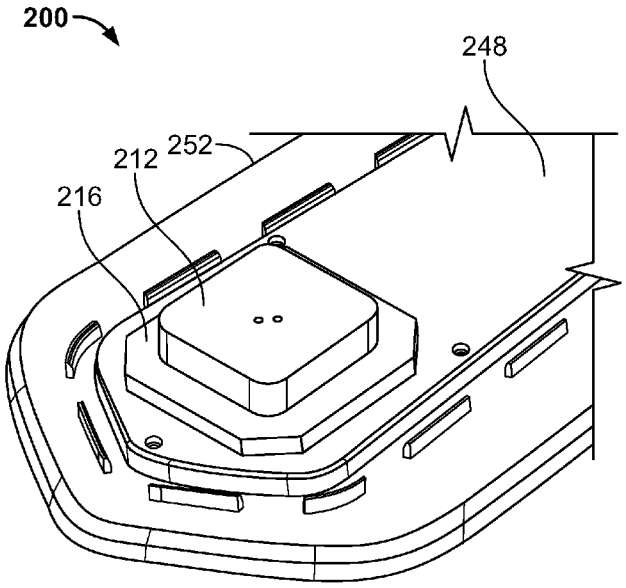
FIG. 10 is a partial perspective view of the multiband antenna assembly shown in FIG. 9.
Figure 11:
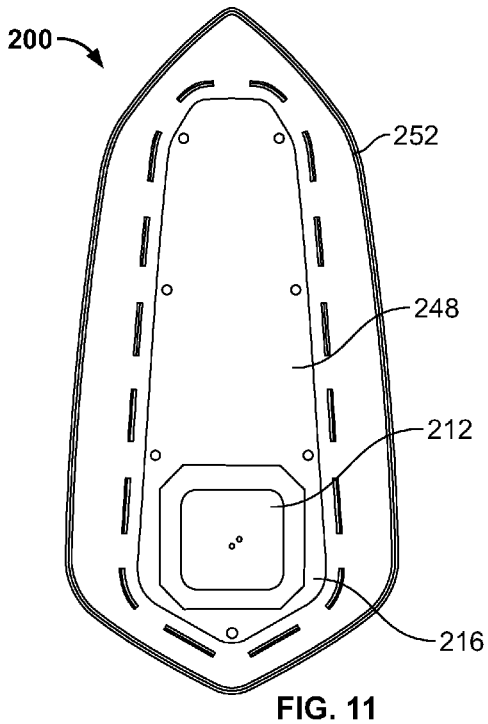
FIG. 11 is an upper view of the multiband antenna assembly shown in FIG. 9.

FIGS. 9 through 11 show the multiband antenna assembly 200 without the radome 244. As shown, the stacked patch antennas 212, 216 are positioned on a printed circuit board 248 and/or supported by a common chassis or base 252. The stacked patch antennas 212, 216 are positioned toward or closer to a front of the PCB 248 and base 252. The antenna assembly 200 may also include one or more other antennas in addition to the GPS/BDS/GLONASS patch antenna 212 and the SDARS patch antenna 216. The one or more other antennas may be located rearward of the patch antennas 212, 216 and/or closer to a back of the antenna assembly 200. For example, an antenna assembly may also include one or more cellular antennas, AM/FM antennas, DABIII/DMB antennas, etc.

FIGS. 12 through 23 provide analysis results for the upper (GPS/BDS/GLONASS) patch antenna 112 of the multiband antenna assembly 100 shown in FIGS. 1 through 4. These results shown in FIGS. 12 through 23 are provided only for purposes of illustration and not for purposes of limitation. In alternative embodiments, the antenna assembly may be configured differently and have different operational or performance parameters than what is shown in FIGS. 12 through 23.

Figure 12:
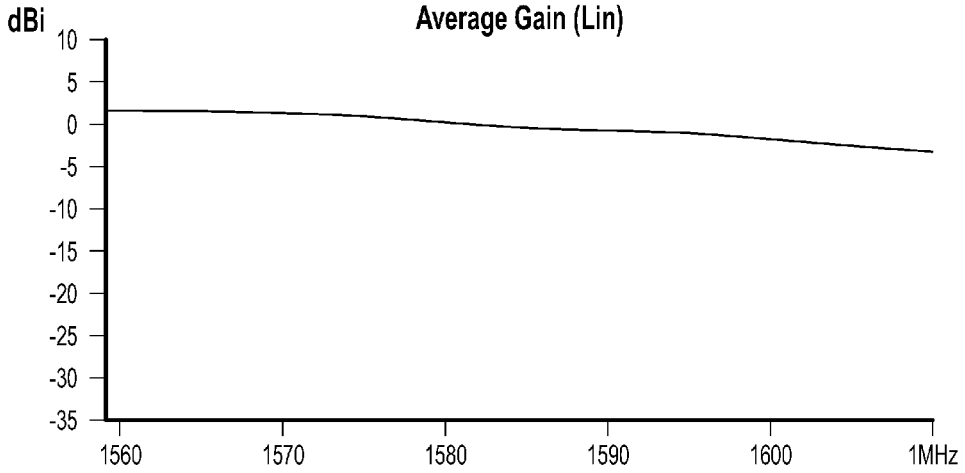
FIG. 12 is a line graph of linear average gain (rotating linear polarization) in decibels-isotropic (dBi) versus frequency in megahertz (MHz) for the upper (GPS/BDS/GLONASS) patch antenna of the multiband antenna assembly shown in FIGS. 1 through 4 on a one-meter diameter ground plane.
Figure 17:
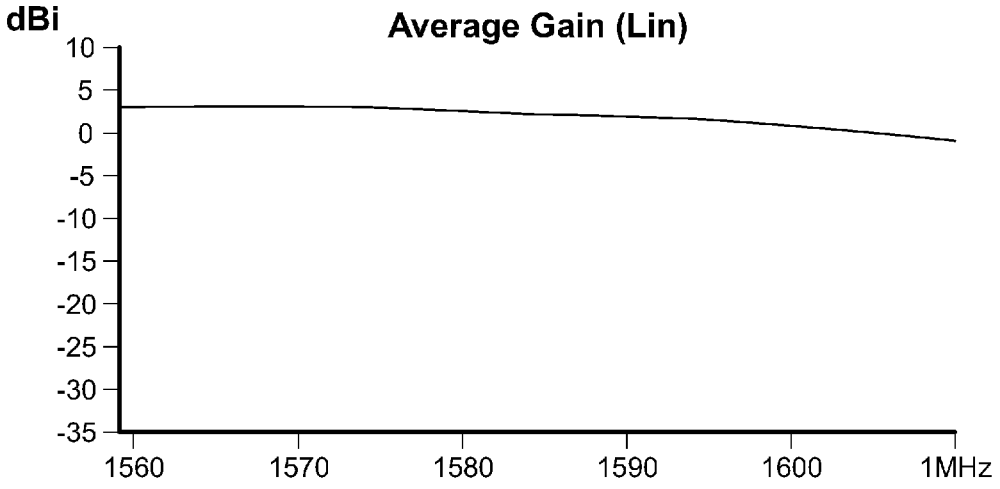
FIG. 17 is a line graph of linear average gain (right hand circular polarization) in decibels-isotropic (dBi) versus frequency in megahertz (MHz) for the upper (GPS/BDS/GLONASS) patch antenna of the multiband antenna assembly shown in FIGS. 1 through 4 on a one-meter diameter ground plane.

FIGS. 12 and 17 are line graphs of linear average gain (rotating linear polarization and right hand circular polarization, respectively) in decibels-isotropic (dBi) versus frequency in megahertz (MHz) for the upper (GPS/BDS/GLONASS) patch antenna 112 of the multiband antenna assembly 100 on a one-meter diameter ground plane. Generally, FIGS. 12 and 17 show that the upper (GPS/BDS/GLONASS) patch antenna 112 had good linear gain across the GPS/BDS/GLONASS frequencies.

Figure 13:
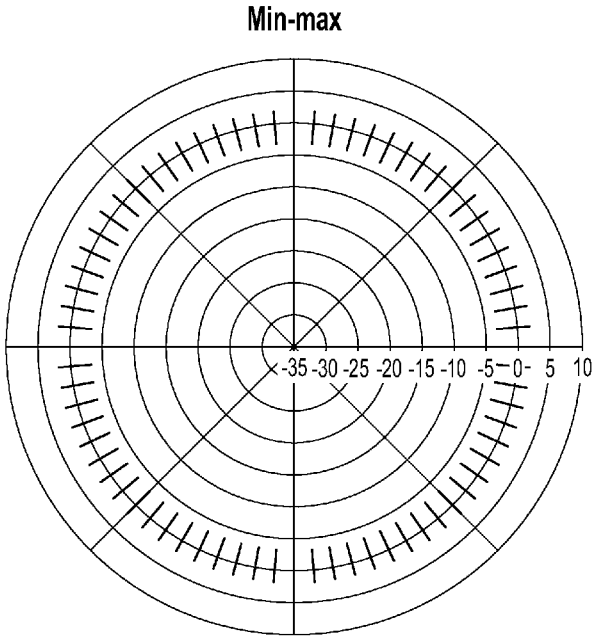
FIGS. 13 through 16 illustrate radiation patterns (linear average gain, rotating linear polarization) at various frequencies for the upper (GPS/BDS/GLONASS) patch antenna of the multiband antenna assembly shown in FIGS. 1 through 4 on a one-meter diameter ground plane.
Figure 14:
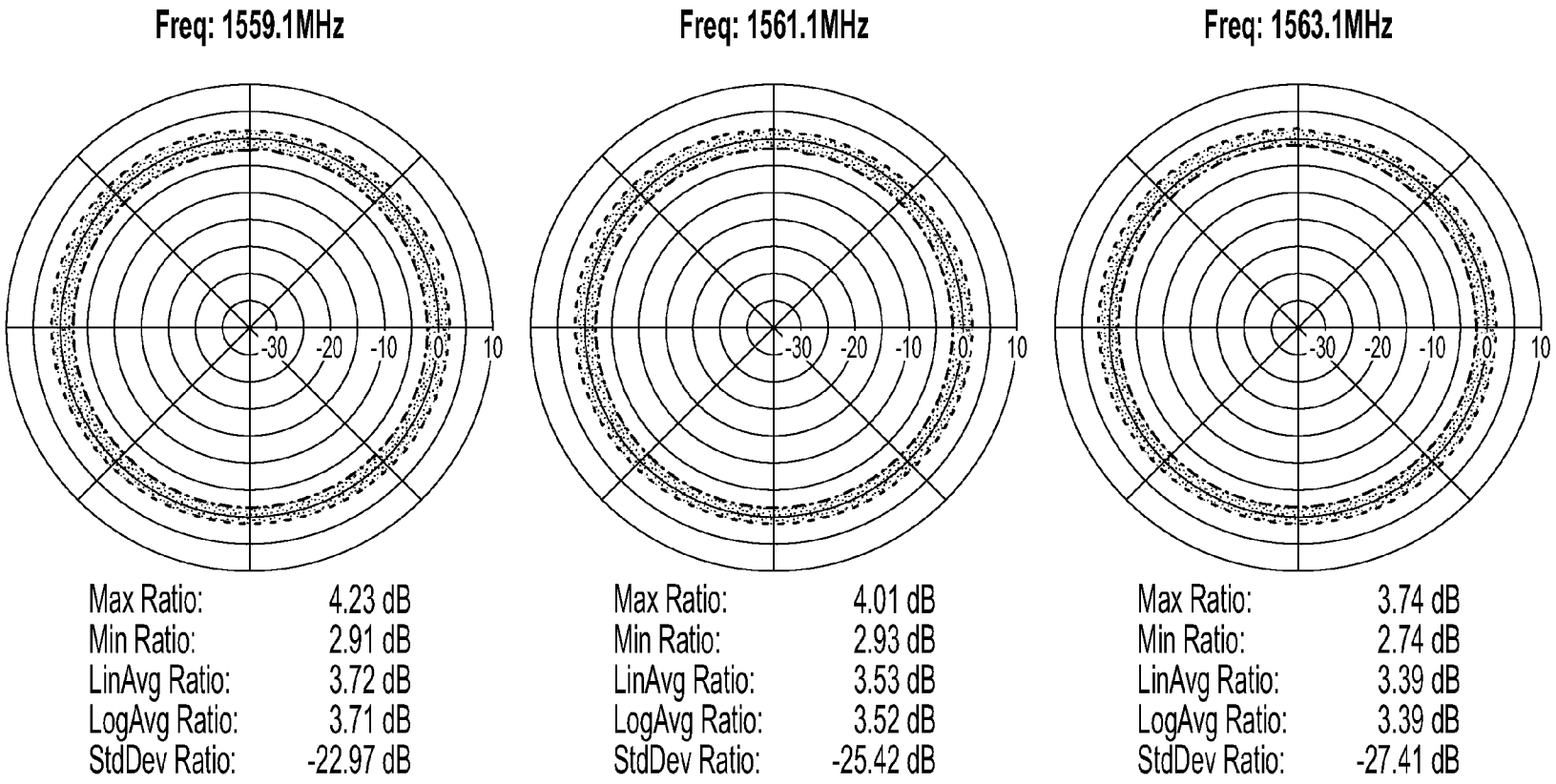
Figure 15:
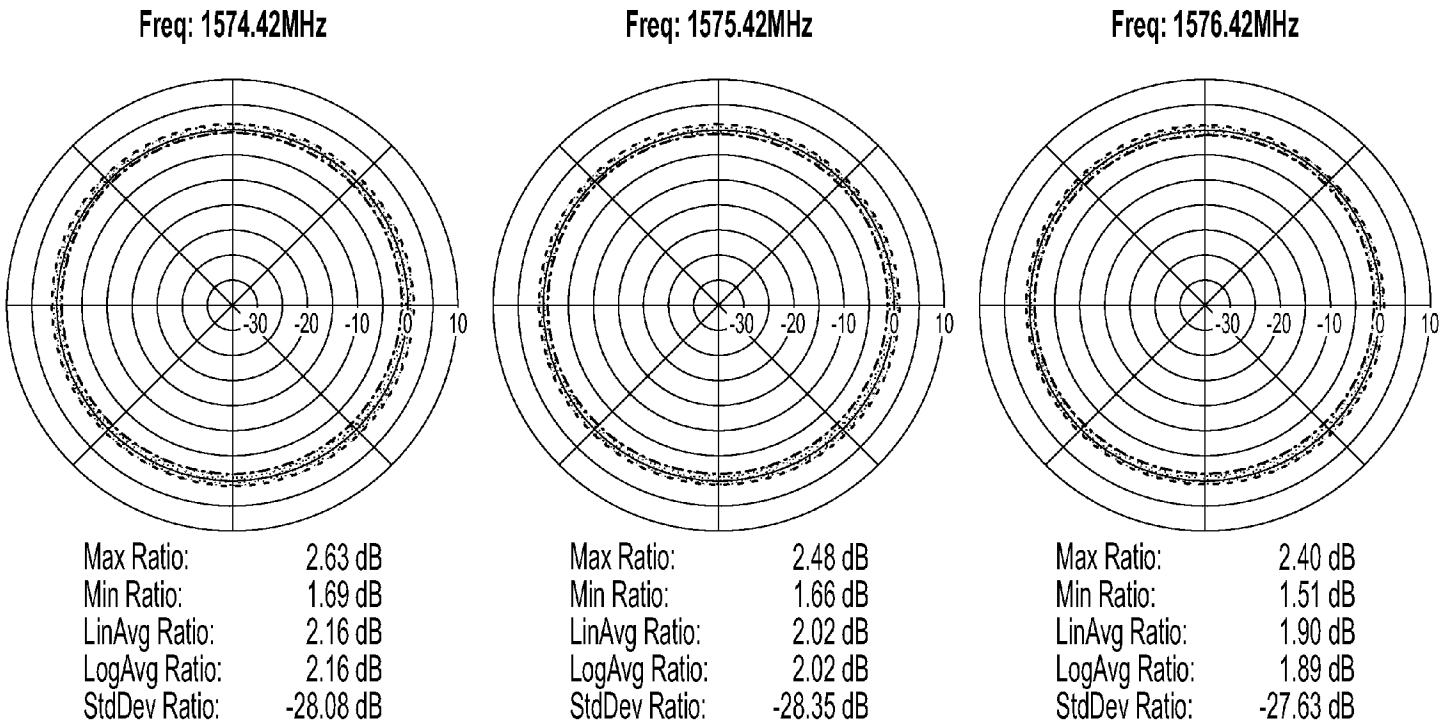
Figure 16:
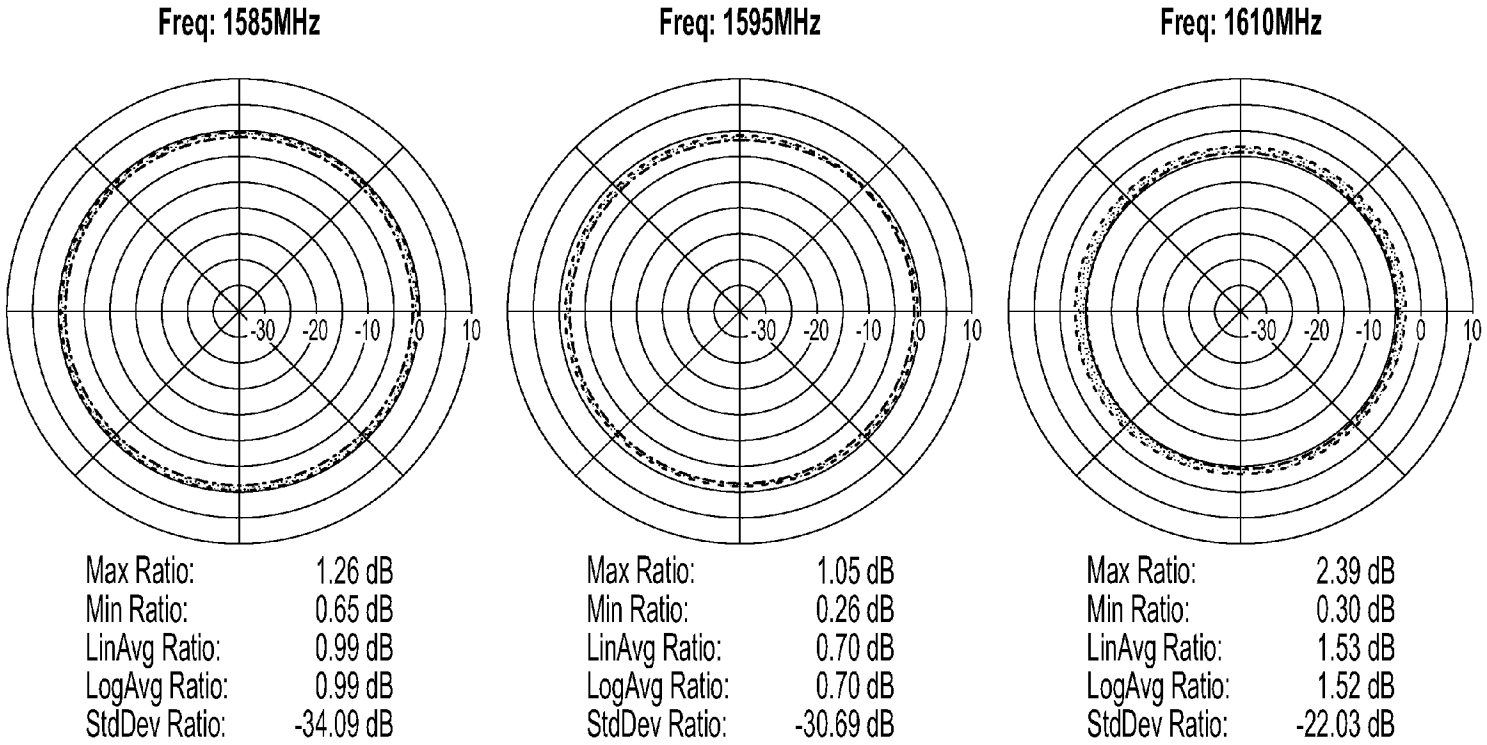

FIGS. 13 through 16 illustrate radiation patterns (linear average gain, rotating linear polarization) at various frequencies for the upper (GPS/BDS/GLONASS) patch antenna 112 of the multiband antenna assembly 100 on a one-meter diameter ground plane. More specifically, FIG. 13 illustrates minimum and maximum average linear gain for the frequencies shown in FIGS. 14 through 16. Generally, FIGS. 13 through 16 show the axial ratio of the antenna in the zenith direction and the good performance of the patch antenna 112 at these frequencies.

Figure 18:
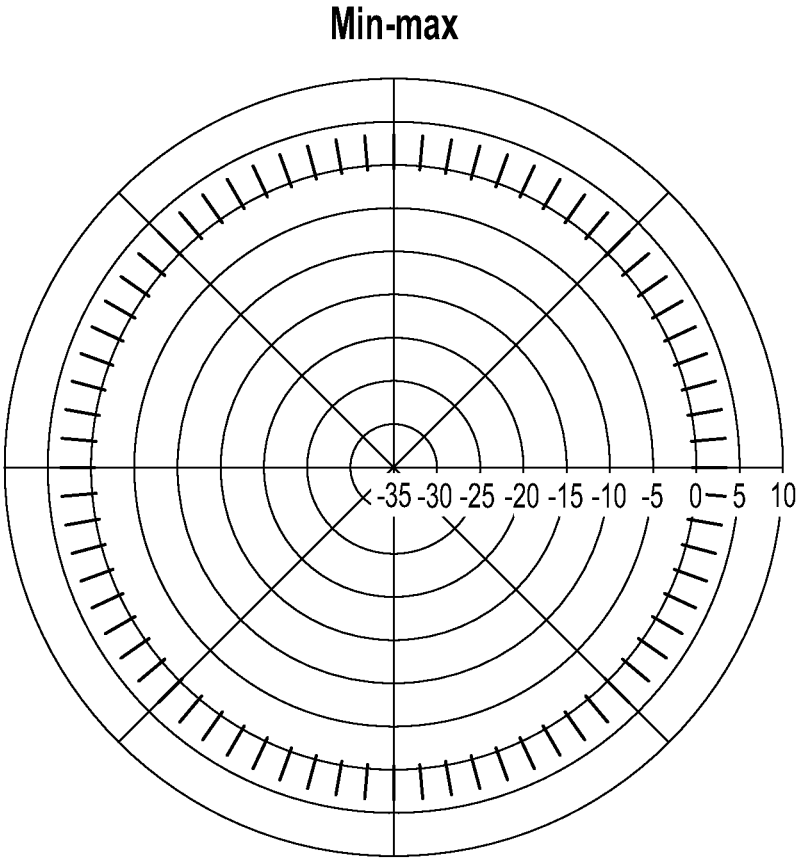
FIGS. 18 through 21 illustrate radiation patterns (linear average gain, right hand circular polarization) at various frequencies for the upper (GPS/BDS/GLONASS) patch antenna of the multiband antenna assembly shown in FIGS. 1 through 4 on a one-meter diameter ground plane.
Figure 19:
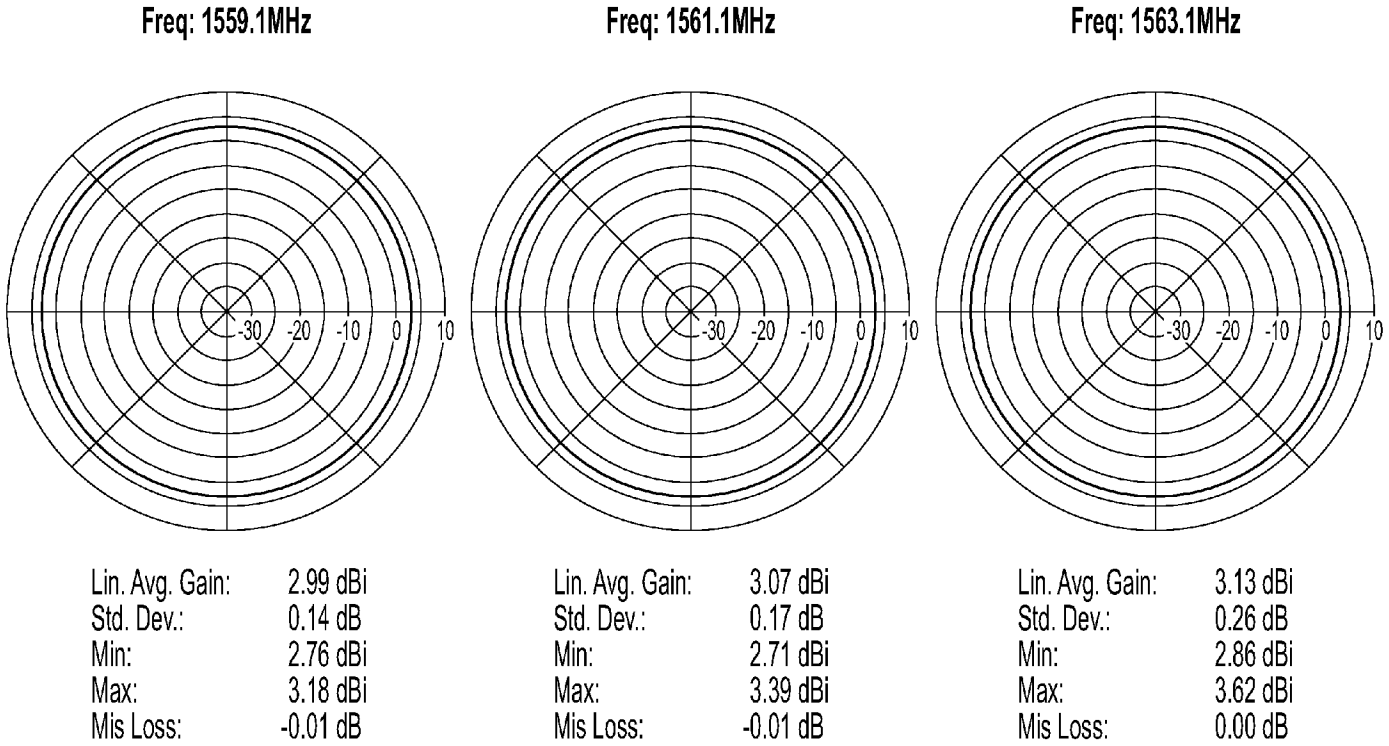
Figure 20:
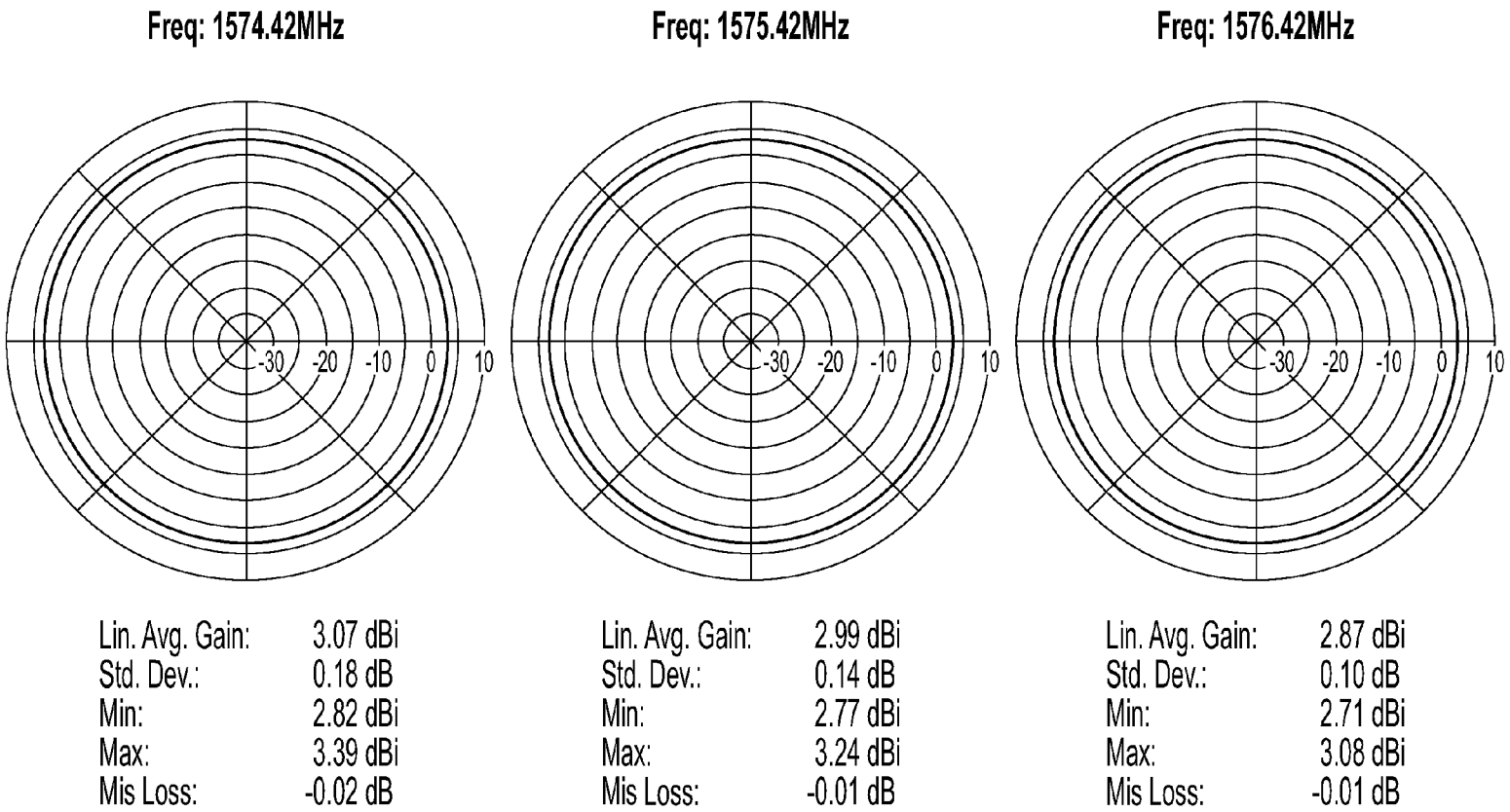
Figure 21:
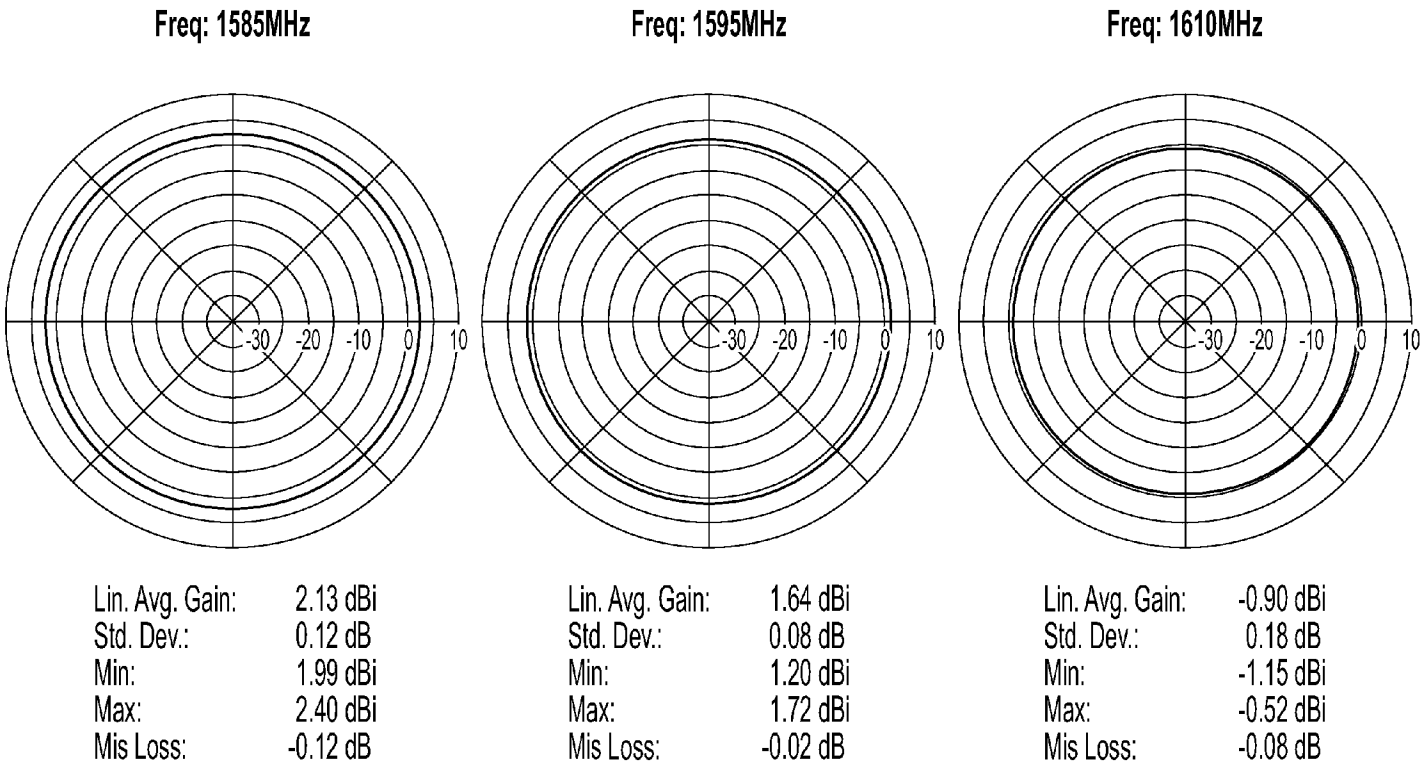

FIGS. 18 through 21 illustrate radiation patterns (linear average gain, right hand circular polarization) at various frequencies for the upper (GPS/BDS/GLONASS) patch antenna 112 of the multiband antenna assembly 100 on a one-meter diameter ground plane. More specifically, FIG. 18 illustrates minimum and maximum average linear gain for the frequencies shown in FIGS. 19 through 21. Generally, FIGS. 18 through 21 show the right hand circular polarization gain of the antenna in the zenith direction and the good performance of the patch antenna 112 at these frequencies.

Figure 22:
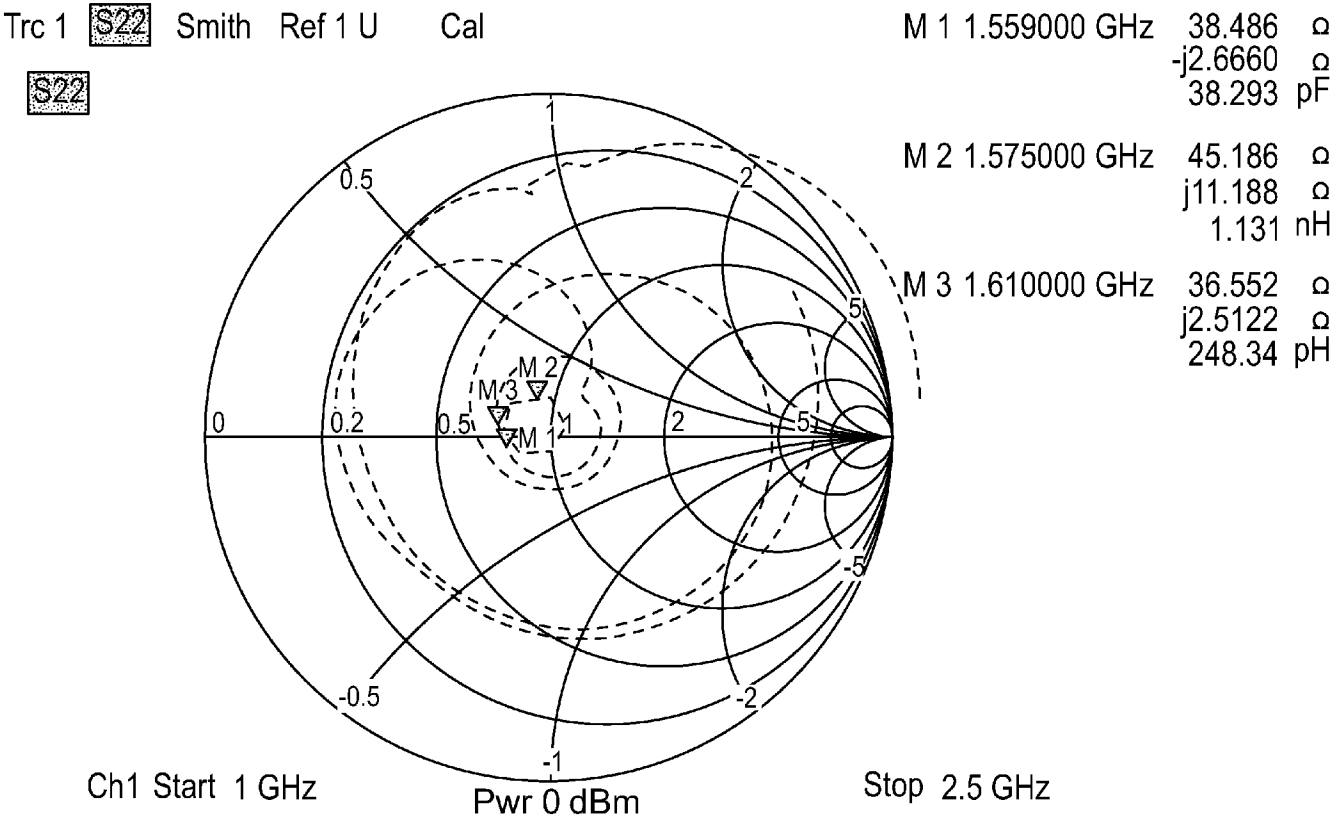
FIG. 22 is a graph showing impedance at a feed port for the upper (GPS/BDS/GLONASS) patch antenna of the multiband antenna assembly shown in FIGS. 1 through 4.
Figure 23:
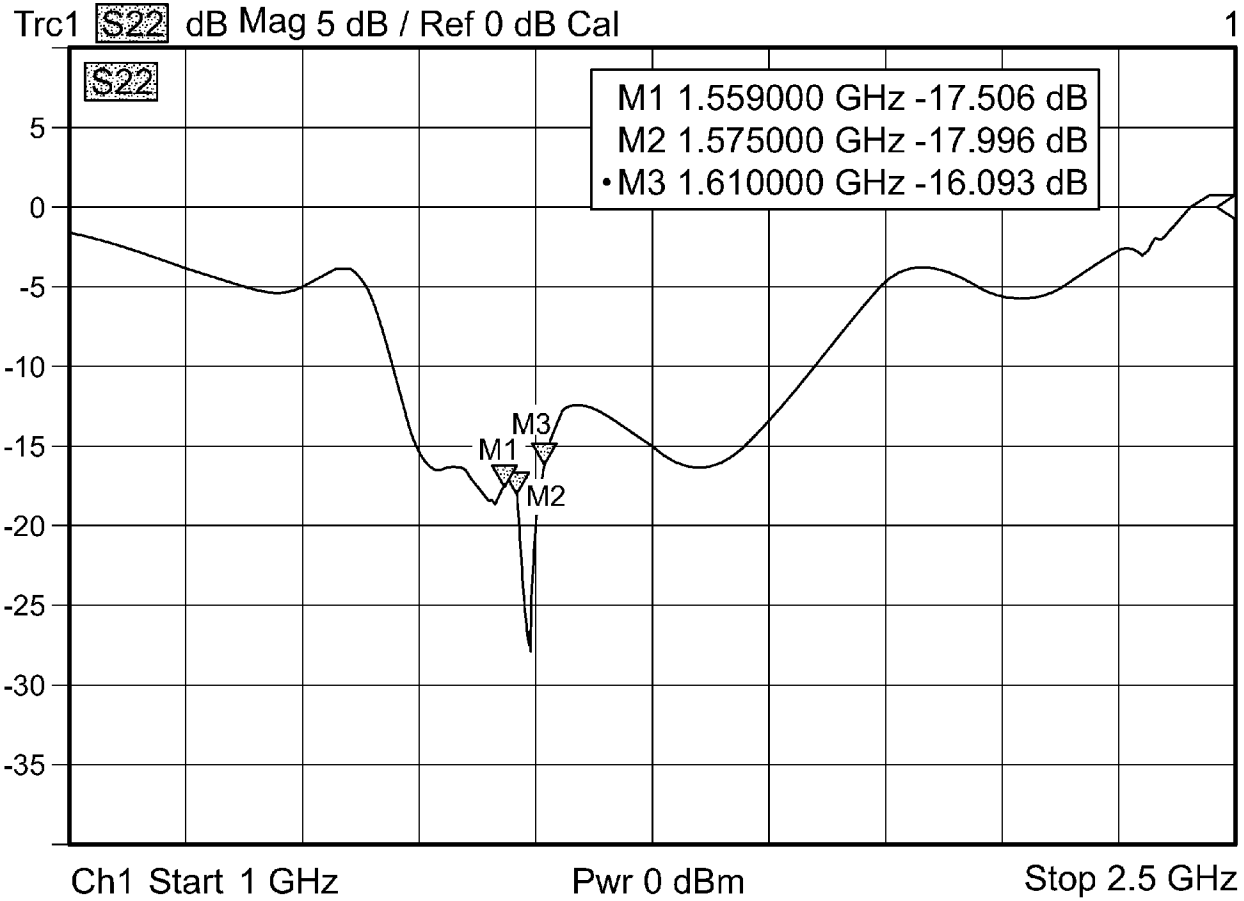
FIG. 23 is a graph showing return loss at a feed port for the upper (GPS/BDS/GLONASS) patch antenna of the multiband antenna assembly shown in FIGS. 1 through 4.

FIG. 22 is a graph showing impedance at a feed port for the upper (GPS/BDS/GLONASS) patch antenna 112 of the multiband antenna assembly 100. FIG. 23 is a graph showing return loss at a feed port for the upper (GPS/BDS/GLONASS) patch antenna 112 of the multiband antenna assembly 100.

Disclosed are exemplary embodiments of multiband vehicular antenna assemblies. In an exemplary embodiment, a multiband vehicular antenna assembly is disclosed that comprises a first antenna configured to be operable with at least three different satellite navigation system frequencies and a coupler configured to be operable for coupling signals from the first antenna. The first antenna may be a first patch antenna configured to be operable with at least Global Positioning System (GPS), BeiDou Navigation Satellite System, and Global Navigation Satellite System (GLONASS) frequencies.

The antenna assembly may also include a second patch antenna operable with one or more frequencies different than the first patch antenna. The first patch antenna may be stacked on the second patch antenna. The first patch antenna may be configured to be operable with GPS, BeiDou Navigation Satellite System, and GLONASS, and the second patch antenna may be configured to be operable with Satellite Digital Audio Radio Services; and/or the first patch antenna may be configured to be operable with frequencies from about 1558 MHz to about 1608 MHz, and the second patch antenna may be configured to be operable with frequencies from about 2320 MHz to about 2345 MHz.

The coupler may comprise a plurality of capacitors, a plurality of inductors, and a resistor electrically connected generally between feed ports of the first patch antenna, an output, and ground. The first patch antenna may include first and second feed ports. The coupler may be electrically connected to the first and second feed ports such that the signals from the first and second feed ports are coupled through the coupler.

The coupler may comprise a plurality of capacitors, a plurality of inductors, and at least one resistor that define a three decibel coupler at frequencies from 1.5 gigahertz to 1.8 gigahertz which is operable for combining signals from the first and second feed ports having a 90 degree phase difference such that the phase at an output port of the antenna assembly is the same. The resistor and one of the plurality of capacitors may be operable to isolate and absorb an unbalanced signal.

The coupler may comprise first, second, and third inductors in parallel with each other, first and second capacitors in series between the first and second feed ports; and third, fourth, and fifth capacitors and a resistor in series between an output and ground. The first and third capacitors may be electrically connected generally between the first and second inductors. The second and fourth capacitors may be electrically connected generally between the second and third inductors. The first, second, and third inductors may each have an inductance within a range from about 4.5 nanoHenries to about 4.9 nanoHenries. For example, the first, second, and third inductors may each have an inductance of 4.7 nanoHenries. The first, second, third, and fourth capacitors may each have a capacitance within a range from about 1.8 picoFarads to about 2.2 picoFarads. For example, the first, second, third, and fourth capacitors may each have a capacitance of 2 picoFarads. The fifth capacitor may have a capacitance within a range from about 90 picoFarads to about 110 picoFarads. For example, the fifth capacitor may have a capacitance of 100 picoFarads. The resistor may have a resistance within a range from about 45 Ohms to about 55 Ohms. For example, the resistor may have a resistance of 51 Ohms.

In exemplary embodiments, a GPS, BDS, and GLONASS patch antenna may be integrated into a roof-mounted antenna assembly such that the antenna functionality, styling, footprint, or attachment scheme may remain the same or essentially the same and not require significant changes despite the additional GPS, BDS, and GLONASS functionality. In addition, various antenna assemblies (e.g., 100, etc.) disclosed herein may be mounted to a wide range of supporting structures, including stationary platforms and mobile platforms. For example, an antenna assembly (e.g., 100, etc.) disclosed herein could be mounted to a supporting structure of a bus, train, aircraft, bicycle, motor cycle, boat, among other mobile platforms. Accordingly, the specific references to motor vehicles or automobiles herein should not be construed as limiting the scope of the present disclosure to any specific type of supporting structure or environment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed above could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband vehicular antenna assembly comprising:

a first patch antenna configured to be operable with at least three different satellite navigation system frequencies; and a coupler configured to be operable for coupling signals from the first patch antenna;

wherein the coupler comprises a plurality of capacitors, a plurality of inductors, and a resistor electrically connected between feed ports of the first patch antenna, an output, and ground.

2. The multiband vehicular antenna assembly of claim 1, wherein:

the first patch antenna includes first and second feed ports; and the coupler is electrically connected to the first and second feed ports such that the signals from the first and second feed ports are coupled through the coupler.

3. The multiband vehicular antenna assembly of claim 1, wherein the first patch antenna is configured to be operable with at least Global Positioning System (GPS), BeiDou Navigation Satellite System, and Global Navigation Satellite System (GLONASS) frequencies.

4. The multiband vehicular antenna assembly of claim 1, further comprising a second patch antenna operable with one or more frequencies different than the first patch antenna, and wherein the first patch antenna is stacked on the second patch antenna.

5. The multiband vehicular antenna assembly of claim 4, wherein:

the first patch antenna is configured to be operable with GPS, BeiDou Navigation Satellite System, and GLONASS, and the second patch antenna is configured to be operable with Satellite Digital Audio Radio Services; and/or the first patch antenna is configured to be operable with frequencies from 1558 MHz to 1608 MHz, and the second patch antenna is configured to be operable with frequencies from 2320 MHz to 2345 MHz.

6. A multiband vehicular antenna assembly comprising:

a first patch antenna configured to be operable with at least three different satellite navigation system frequencies; and a coupler configured to be operable for coupling signals from the first patch antenna;

wherein:

the first patch antenna includes first and second feed ports;

the coupler is electrically connected to the first and second feed ports such that the signals from the first and second feed ports are coupled through the coupler;

the coupler comprises a plurality of capacitors, a plurality of inductors, and at least one resistor that define a three decibel coupler at frequencies from 1.5 gigahertz to 1.8 gigahertz which is operable for combining signals from the first and second feed ports having a 90 degree phase difference such that the phase at an output port of the antenna assembly is the same; and the resistor and one of the plurality of capacitors are operable to isolate and absorb an unbalanced signal.

7. The multiband vehicular antenna assembly of claim 6, wherein the plurality of capacitors, the plurality of inductors, and the resistor are electrically connected between the first and second feed ports of the first patch antenna, an output, and ground.

8. A multiband vehicular antenna assembly comprising:

a first patch antenna configured to be operable with at least three different satellite navigation system frequencies; and a coupler configured to be operable for coupling signals from the first patch antenna;

wherein:

the first patch antenna includes first and second feed ports;

the coupler comprises:

first, second, and third inductors in parallel with each other;

first and second capacitors in series between the first and second feed ports; and third, fourth, and fifth capacitors and a resistor in series between an output and ground.

9. The multiband vehicular antenna assembly of claim 8, wherein:

the first and third capacitors are electrically connected between the first and second inductors; and the second and fourth capacitors are electrically connected between the second and third inductors.

10. The multiband vehicular antenna assembly of claim 8, wherein:

the first inductor has an inductance within a range from 4.5 nanoHenries to 4.9 nanoHenries;

the second inductor has an inductance within a range from 4.5 nanoHenries to 4.9 nanoHenries;

the third inductor has an inductance within a range from 4.5 nanoHenries to 4.9 nanoHenries;

the first capacitor has a capacitance within a range from 1.8 picoFarads to 2.2 picoFarads;

the second capacitor has a capacitance within a range from 1.8 picoFarads to 2.2 picoFarads;

the third capacitor has a capacitance within a range from 1.8 picoFarads to 2.2 picoFarads;

the fourth capacitor has a capacitance within a range from 1.8 picoFarads to 2.2 picoFarads;

the fifth capacitor has a capacitance within a range from 90 picoFarads to 110 picoFarads; and the resistor has a resistance within a range from 45 Ohms to 55 Ohms.

11. The multiband vehicular antenna assembly of claim 8, wherein:

the first inductor has an inductance of 4.7 nanoHenries;

the second inductor has a inductance of 4.7 nanoHenries;

the third inductor has a inductance of 4.7 nanoHenries;

the first capacitor has a capacitance of 2 picoFarads;

the second capacitor has a capacitance of 2 picoFarads;

the third capacitor has a capacitance of 2 picoFarads;

the fourth capacitor has a capacitance of 2 picoFarads;

the fifth capacitor has a capacitance of 100 picoFarads; and the resistor has a resistance of 51 Ohms.

12. A multiband vehicular antenna assembly comprising:

a first antenna comprising first and second feed ports, the first antenna configured to be operable with at least three different satellite navigation system frequencies; and a coupler electrically connected to the first and second feed ports such that signals from the first and second feed ports are coupled through the coupler;

wherein the coupler comprises a plurality of capacitors, a plurality of inductors, and a resistor electrically connected between the first and second feed ports, an output, and ground.

13. The multiband vehicular antenna assembly of claim 12, wherein:

the plurality of capacitors, the plurality of inductors, and the resistor define a three decibel coupler at frequencies from 1.5 gigahertz to 1.8 gigahertz which is operable for combining signals from the first and second feed ports having a 90 degree phase difference such that the phase at the output is the same; and the resistor and one of the plurality capacitors are operable to isolate and absorb an unbalanced signal.

14. The multiband vehicular antenna assembly of claim 12, wherein the first antenna is configured to be operable with at least Global Positioning System (GPS), BeiDou Navigation Satellite System, and Global Navigation Satellite System (GLONASS) frequencies.

15. The multiband vehicular antenna assembly of claim 12, further comprising a second patch antenna operable with one or more frequencies different than the first antenna, and wherein the first antenna comprises a first patch antenna stacked on the second patch antenna, and wherein:

the first patch antenna is configured to be operable with GPS, BeiDou Navigation Satellite System, and GLONASS, and the second patch antenna is configured to be operable with Satellite Digital Audio Radio Services; and/or the first patch antenna is configured to be operable with frequencies from 1558 MHz to 1608 MHz, and the second patch antenna is configured to be operable with frequencies from 2320 MHz to 2345 MHz.

16. A multiband vehicular antenna assembly comprising:

a first antenna comprising first and second feed ports, the first antenna configured to be operable with at least three different satellite navigation system frequencies; and a coupler electrically connected to the first and second feed ports such that signals from the first and second feed ports are coupled through the coupler;

wherein the coupler comprises:

first, second, and third inductors in parallel with each other;

first and second capacitors in series between the first and second feed ports; and third, fourth, and fifth capacitors and a resistor in series between an output and ground.

17. The multiband vehicular antenna assembly of claim 16, wherein:

the first and third capacitors are electrically connected between the first and second inductors; and the second and fourth capacitors are electrically connected between the second and third inductors.

18. The multiband vehicular antenna assembly of claim 16, wherein:

the first inductor has an inductance within a range from 4.5 nanoHenries to 4.9 nanoHenries;

the second inductor has an inductance within a range from 4.5 nanoHenries to 4.9 nanoHenries;

the third inductor has an inductance within a range from 4.5 nanoHenries to 4.9 nanoHenries;

the first capacitor has a capacitance within a range from 1.8 picoFarads to 2.2 picoFarads;

the second capacitor has a capacitance within a range from 1.8 picoFarads to 2.2 picoFarads;

the third capacitor has a capacitance within a range from 1.8 picoFarads to 2.2 picoFarads;

the fourth capacitor has a capacitance within a range from 1.8 picoFarads to 2.2 picoFarads;

the fifth capacitor has a capacitance within a range from 90 picoFarads to 110 picoFarads; and the resistor has a resistance within a range from 45 Ohms to 55 Ohms.

19. The multiband vehicular antenna assembly of claim 16, wherein:

the first inductor has an inductance of 4.7 nanoHenries;

the second inductor has an inductance of 4.7 nanoHenries;

the third inductor has an inductance of 4.7 nanoHenries;

the first capacitor has a capacitance of 2 picoFarads;

the second capacitor has a capacitance of 2 picoFarads;

the third capacitor has a capacitance of 2 picoFarads;

the fourth capacitor has a capacitance of 2 picoFarads;

the fifth capacitor has a capacitance of 100 picoFarads; and the resistor has a resistance of 51 Ohms.

* * * * *